United States Patent [19]

Doshi

[11] Patent Number: 4,932,574

[45] Date of Patent: Jun. 12, 1990

[54] CONVERTIBLE COAT AND CARRYING MEANS AND METHOD

[76] Inventor: Jyoti J. Doshi, 222 Washington St., Apt. 2R, Brookline, Mass. 02146

[21] Appl. No.: 177,602

[22] Filed: Apr. 5, 1988

Related U.S. Application Data

[63] Continuation-in-part of Ser. No. 879,021, Jun. 26, 1986, abandoned.

[51] Int. Cl.[5] ..... A45F 4/02

[52] U.S. Cl. ..... 224/153; 224/151; 2/94

[58] Field of Search ..... 224/151, 153; 2/69, 2/69.5, 85, 86, 93, 94, 108

[56] References Cited

U.S. PATENT DOCUMENTS

| | | | |
|---|---|---|---|
| 1,959,331 | 5/1934 | Bour | 2/94 |
| 2,165,348 | 7/1939 | Daiber | 2/94 |
| 4,502,155 | 3/1985 | Itos | 2/94 |
| 4,637,076 | 1/1987 | Tartt et al. | 224/151 |
| 4,689,831 | 9/1987 | Greenberger et al. | 2/94 |

FOREIGN PATENT DOCUMENTS

| | | | |
|---|---|---|---|
| 203249 | 10/1908 | Fed. Rep. of Germany | 2/85 |

*Primary Examiner*—Linda J. Sholl
*Attorney, Agent, or Firm*—Donald W. Meeker

[57] ABSTRACT

A double belt or extra long single belt is secured around an article of clothing such as a coat. The garment is folded into a bundle and a first belt segment secured into a loop around the bundle. Two free belt ends are secured from the first belt segment and wrapped around the bundle and secured to attaching means on the upper portion of the garment to form carrying loops. Attaching means include buttons, hook-and-loop fasteners, buckles and tieing. The bundle may receive other articles for carrying. The bundle may be carried as a backpack, over the arm or grasped by hand as a briefcase. Mating hook and loop fasteners applied to the sides of the garment secured the sides of the carrying bag. Alternately pairs of loops may be applied to the article of clothing on separate portions of the garment so that when the garment is folded larger loops may be inserted through smaller loops to secure the carrying bag and serve as carrying means. The elements to be applied to the garment may be provided in a kit to be applied to existing articles of clothing.

12 Claims, 5 Drawing Sheets

FIG. 2
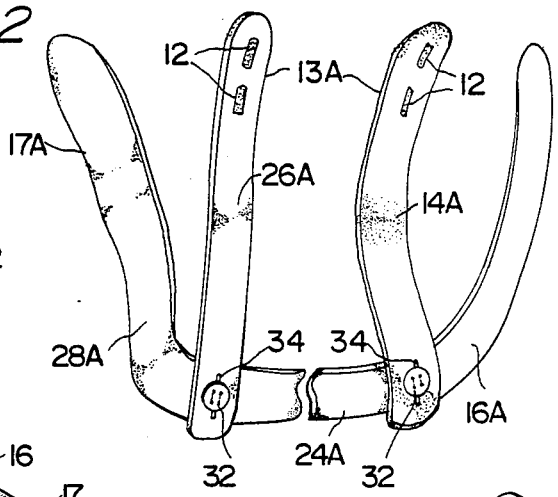
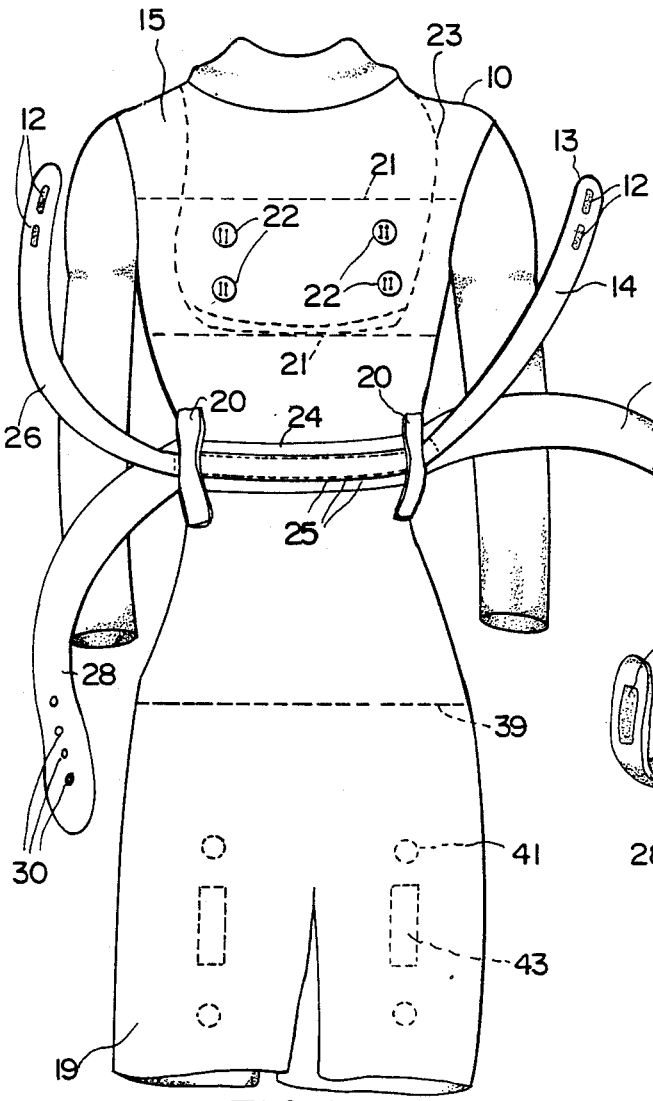
FIG. 1
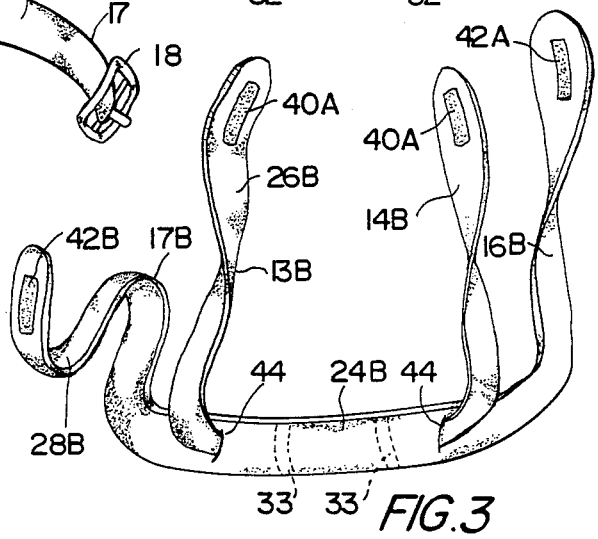
FIG. 3
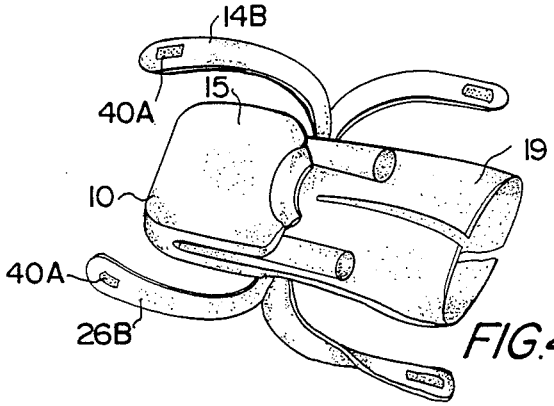
FIG. 4
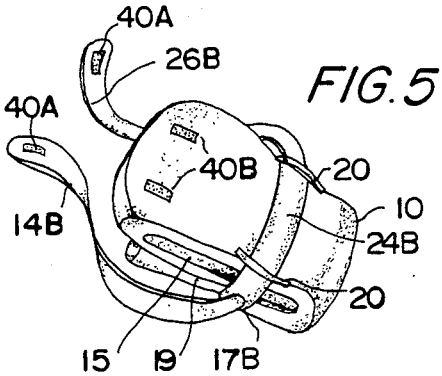
FIG. 5
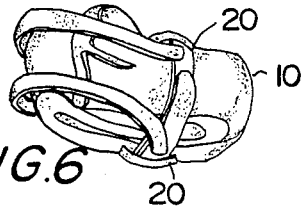
FIG. 6

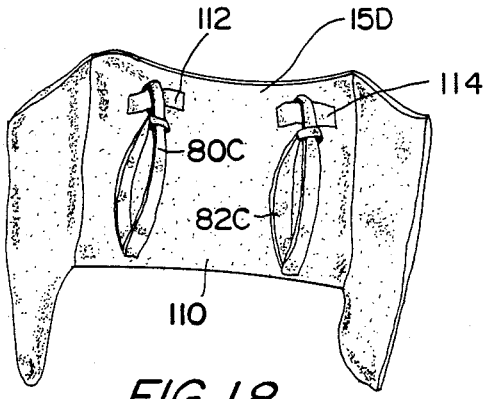
FIG. 18
FIG. 19
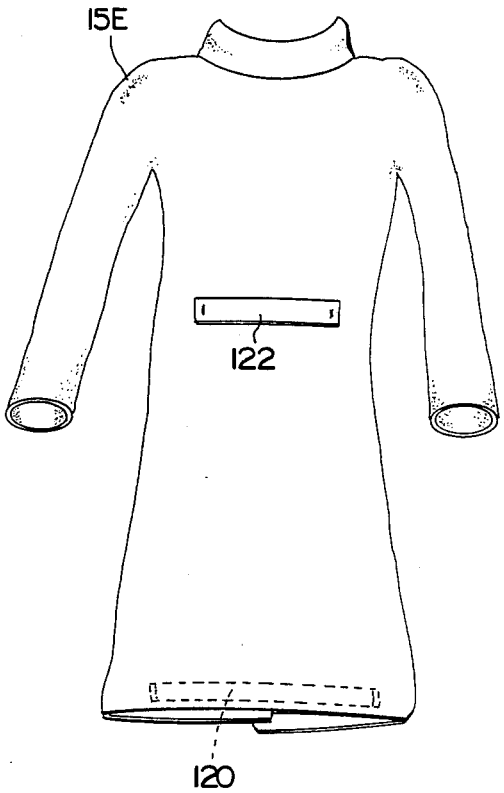
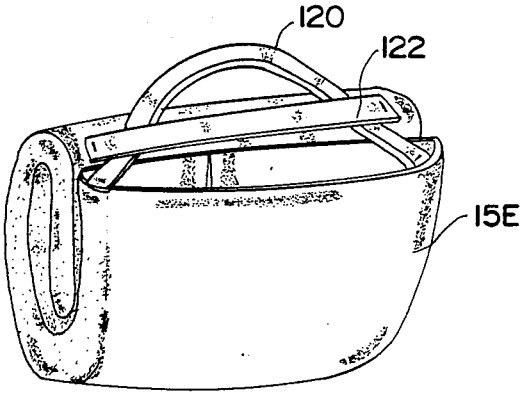
FIG. 20
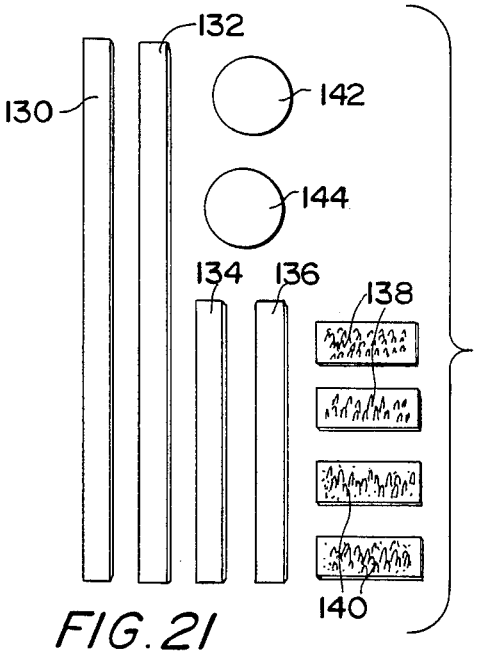
FIG. 21

FIG. 22
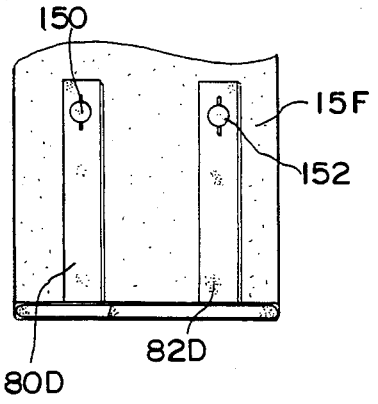
FIG. 23
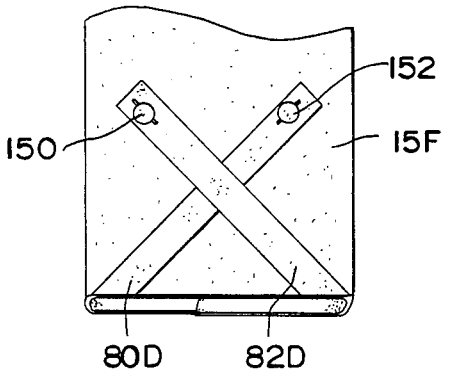
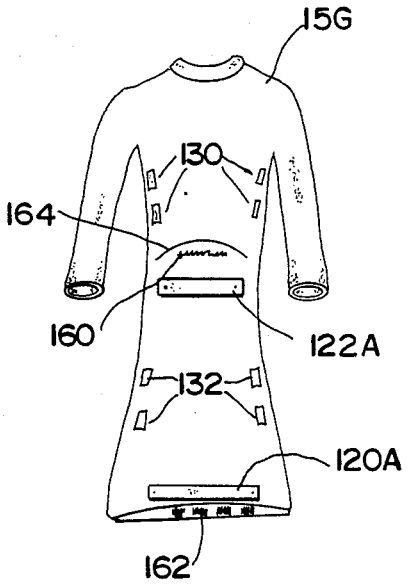
FIG. 24
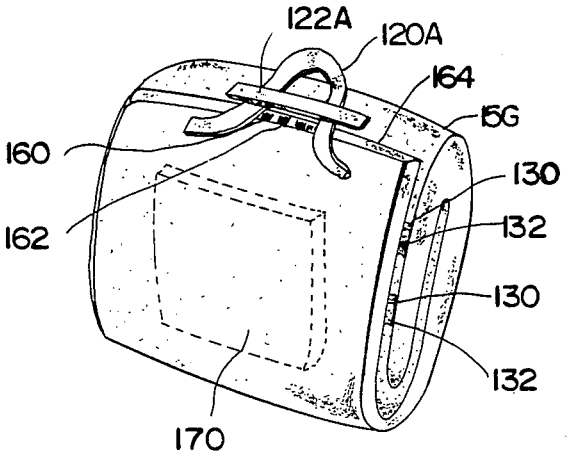
FIG. 25

CONVERTIBLE COAT AND CARRYING MEANS AND METHOD

CROSS-REFERENCES TO RELATED APPLICATIONS

This is a continuation-in-part of application Ser. No. 879,021 filed 6/26/86, abandoned.

BACKGROUND OF THE INVENTION

1. Technical Field

The present invention relates to convertible apparel and in particular to a coat which converts from a wearable article of clothing to a self-contained bundle which may serve as a carrying bag having its own carrying means.

2. Background Art

Most coats or outer garments for protection in cold or inclement weather are very bulky, heavy and often large posing a problem for transporting when the coat is taken off due to warmer weather or when the wearer is indoors. Out of doors, the wearer is faced with the prospect of carrying the coat around wherever he or she is traveling. If no safe location is available for hanging indoors, the wearer will have to carry the coat around probably draped over the wearer's arm. The task is particularly burdensome and tiring when the environment is very warm or when the coat is wet from inclement weather and when the wearer has other items to carry.

Many coats are provided with a loop means, often inside of the collar, for hanging the coat, but no means for aiding in carrying the coat. If carried by the loop the weight of the coat cuts the loop into the fingers and the coat would likely be draped over the shoulder of the wearer.

3. Disclosure of Invention

Combining a double belt retained by belt loops on a coat with a securing means positioned elsewhere on the coat to receive two ends of the belt, enables the folding of the coat into a contained bundle secured by one belt and conveniently transported using loops formed by the other two secured belt ends as carrying straps.

A double belt forms a tieing means around the coat and a double strap carrying means by securing the two ends of the second belt over the top of the coat securing the belt ends to fastening means on the other side of the coat, thereby creating a double loop which may be hooked over the two arms of the wearer to carry the coat as one would carry a backpack. Alternately, one arm may be inserted through the strap and the coat carried over the arm or one hand may grasp the straps and the coat carried as one would carry a brief case.

A single belt with two partial belts may be used by attaching the partial belts to the single belt at one end and attaching the opposite end of the partial straps to the attaching means on the other side of the coat providing partial strap means which may be stored in pockets of the coat when not in use.

A single long belt may be tied around the bundle and the two ends of the single belt looped around the bundle and secured to an attaching means to form carrying means, thereby creating a simplified carrying means.

Folding the coat into a closed configuration prior to securing with the belt provides a secure means for carrying items folded within the coat.

A double belt further serves as a novel decorative element with two colors or mixed color and pattern.

Covering means for the fasteners on the back of the coat also serve as decorative means with patterns or colors coordinated with other parts of the coat in addition to the function of covering the fastening means.

Wholly or partially concealed large loops of material inserted through smaller loops provides a fast, convenient way to create a carrying bag which is not obvious and does not interfer with the fashion design of the article of clothing.

Providing two pairs of loops, two buttons if necessary and Velcro fasteners if desired creates an inexpensive easy-to-apply kit for a user to transform an existing article of clothing into a convertible carrying bag of any desired fashion and placement of loop elements.

Mating hook and loop fasteners or other mating fastening means attached to the sides of the article of clothing provide a convenient lightweight means to secure the sides of the bundle so that objects may be carried inside the bundle without fear of losing them.

BRIEF DESCRIPTION OF THE DRAWINGS

These and other details and advantages of my invention will be described in conjunction with the accompanying drawings, which are furnished only by way of illustration and not in limitation of the invention, and in which drawings:

FIG. 1 as a back elevational view of a convertible coat having a first buckled belt and a second belt stitched to the first, the two ends of which second belt are buttoned to an upper portion of the coat to form carrying loops;

FIG. 2 is a perspective view of an alternate embodiment of the double belt of the invention having a first tie belt with two additional belt ends buttoned to the first belt;

FIG. 3 is a perspective view of another alternate embodiment of the double belt having the second belt inserted within a hollow interior of the first belt, wherein the first belt is secured together by mating hook-and-loop fasteners and the second belt is secured to an upper portion of the coat by hook-and-loop fasteners to form carrying loops;

FIG. 4 is a perspective view of the coat with the top portion folded over the belt area of the coat as a first step in forming a carrying bundle;

FIG. 5 is a perspective view showing the bottom portion of the coat folded over the top portion to form the bundle and the first belt secured around the bundle, with a view of the hook-and-loop fasteners attached to the upper back portion of the coat, to which fasteners the second belt ends will be secured;

FIG. 6 is a perspective view of the bundle with the second belt ends secured to an upper portion of the coat to form carrying loops;

FIG. 18 is a partial perspective view of an alternative embodiment of the coat having a bottom concealed interior pair of large loops tied to interior loops while wearing the coat;

FIG. 19 is a perspective view of the back of a coat having a large interior bottom strip forming a large loop with the coat and a midsection exterior strip forming a smaller loop with the coat;

FIG. 20 is a perspective view of the embodiment of FIG. 19 folded and secured into a carrying bag;

FIG. 21 is a plan view of the elements of a kit used to transform an existing article of clothing into an article of clothing which converts to a carrying bag;

FIG. 22 is a partial perspective view of an alternate embodiment having external strips extending vertically from the bottom of the coat and buttoned to the coat when being worn;

FIG. 23 is a partial perspective view of the alternate embodiment of FIG. 22 with the strips of material extending at an angle and criss-crossed;

FIG. 24 is a perspective view of a coat having concealed zipper elements and loops;

FIG. 25 is a perspective view of the coat of FIG. 24 secured into a carrying bag with the zipper elements connected and one loop inserted through the other for a handle.

BEST MODE FOR CARRYING OUT THE INVENTION

Figure 7:
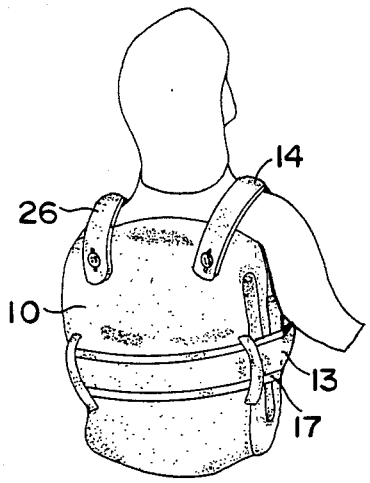
FIG. 7 is a perspective view of the bundle with the arms of the wearer hooked through the carrying loops so that the bundle is carried as a backpack.

In FIG. 1 a coat 10 or any other article of clothing is fitted with belt loops 20 to secure a double belt to the coat. The first belt 17 secures together around the waist of the wearer in a conventional manner with the two ends of the first belt 16 and 28 secured together by a fastening means such as a buckle 18 and holes 30. Alternate fastening means include plain ends 16A and 28A of FIG. 2 to tie together, hook-and-loop mating fasteners 42A and 42B as in FIG. 3 or any other means of securing the two ends of the belt together.

Again in FIG. 1, a second belt 13 is secured to the first belt by stitching 25 over a central portion 24 of the first belt leaving the ends 14 and 26 of the second belt free. Alternate modes of attaching the second belt to the first belt include buttoning the two second belt ends 14A and 26A by buttons 32 through button-holes 34 as in FIG. 2, inserting the second belt 13B through slots 44 into a hollow interior mid-section 24B of the first belt 17B as in FIG. 3, inserting the second belt through loops 33 (dashed lines) as in FIG. 3 or any other means. The loops 33 may also be used for inserting the two ends 14B and 26B of the second belt through the loops 33 to secure them to the first belt 17B when the first belt is secured around the waist of the wearer. Alternately the two ends of the second belt may also be secured around the waist of the wearer as a second belt.

On the back of the top 15 portion of the coat buttons 22 are attached to receive the two ends 14 and 26 through the button holes 12 of the second belt when the coat is folded in a bundle so that the second belt ends thus secured serve as carrying loops as seen in FIG. 6. Multiple buttons 22 and multiple button holes 12 allow for adjustability to create loops of varying sizes for different carrying modes or to allow for articles of varying sizes to be secured within the bundle. Alternate attaching means for the two ends of the second belt include hook-and-loop fasteners 40B, such as Velcro, shown in FIG. 5. The fastening means attached to the upper back of the coat may be left visible and form a decorative pattern or they may be covered by a panel 21 (shown with dashed lines) as an additional decorative means or covered by a standard hood 23.

The horizontal dashed line 39 below the belt indicates that the invention works equally well on a shorter coat. The dashed strips 43 and dashed circles 41 near the bottom of the coat indicate that the bottom of the coat may be folded over and secured to mating securing means at the top of the coat for a self securing bundle not requiring the first belt as a securing means.

FIGS. 4, 5 and 6 illustrate the sequence of folding the coat into a bundle for carrying. In FIG. 4 the top 15 of the coat is folded over the front of the coat with the belt ends all extended. In FIG. 5 the bottom 19 of the coat is folded over the top 15 to complete the bundle. The first belt 17B is then secured around the bundle to hold it firmly closed. Other objects may be secured within the bundle for carrying with the coat. In FIG. 5 the two hook-and-loop fasteners 40A of the two belt ends 14B and 26B are secured to the two hook-and-loop fasteners 40B attached to the upper back of the coat to form the loops for carrying the bundle as shown in FIG. 6.

Figure 8:
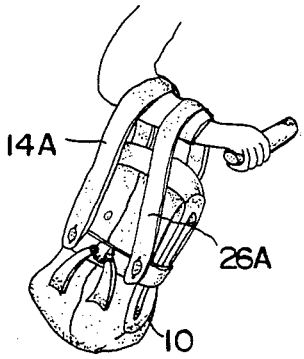
FIG. 8 is a perspective view of the bundle with the arm of the wearer hooked through the carrying loops so that the bundle is carried on the arm of the wearer.
Figure 9:
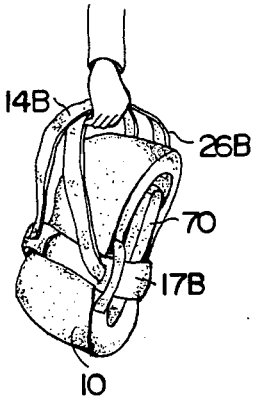
FIG. 9 is a perspective view of the bundle with the hand of the wearer grasping the carrying loops so that the bundle is carried like a brief case.

In FIG. 7 the bundle is shown worn on a wearer's back like a backpack with the arms of the wearer through the carrying loops. In FIG. 8 the bundle is shown carried over the arm of the wearer with the wearer's arm through the carrying loops leaving the wearer's hands free. In FIG. 9 the bundle is shown carried like a brief case with the hand of the wearer grasping the carrying loops, and indicating a package 70 contained within the bundle.

Figure 10:
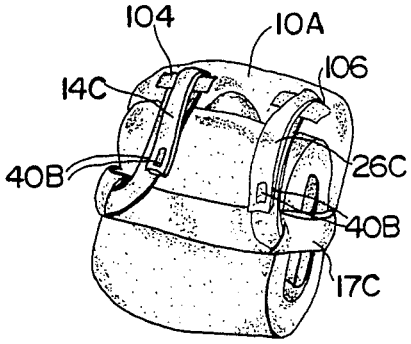
FIG. 10 is a perspective view of the bundle with the ends of the double belt inserted through loops on the shoulders of the coat with the ends doubled back and connected to themselves with hook and loop fasteners.

In FIG. 10 an alternate embodiment of the coat 10A provides loops 104 and 106 secured to the shoulder portion of the coat. When the coat is folded into a bundle the second belt ends 14C and 26C are inserted through the loops 104 and 106 and the belt ends are doubled back and secured to themselves by mating loop and hook fasteners 40B or other means to secure the bundle and create loops of the belt ends for carrying the carrying bag.

Figure 11:
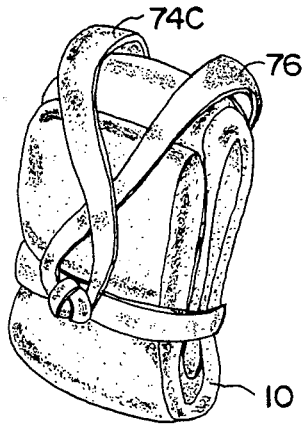
FIG. 11 is a perspective view of an alternate embodiemnt of the bundle having a single belt tied around the bundle with the ends of the same belt secured to the opposite end of the bundle to form carrying loops.
Figure 12:
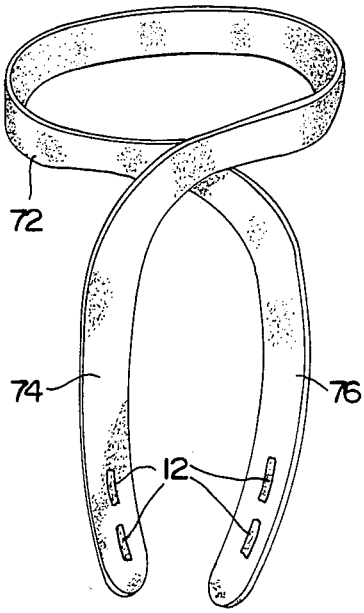
FIG. 12 is a perspective view of the long single belt of FIG. 11.

In FIGS. 11 and 12 an alternate embodiment provides a simplified version of the invention having a single belt means 72 which serves the function of both the first and second belts of the previous embodiments. The single belt 72 is tied around the bundle to secure it and then the two ends 74 and 76 of the long belt are draped over the bundle and secured to the bundle by buttons to the botton holes 12 or other securing means which may be applied to form carrying loops. Criss-crossing the ends of the long belt before securing them to the bundle lends stability to the carrying loops.

Although a coat is shown to illustrate the invention it is understood that the invention may be applied to any article of clothing which can receive a double belt means. Any material may be used or fastening means. The invention rests in the novel way to convert an article of clothing into a bundle having its own self-contained carrying means.

Another embodiment of the invention of provides a securing/carrying means in the form of an elongated element comprising at least one large loop secured to the article of clothing and a second element comprising at lease one small loop attached to the article of clothing at a distance from the large loop, wherein the large loop is inserted through the small loop to secure the bundle and the large loop is used for carrying the secured bundle.

Figure 13:
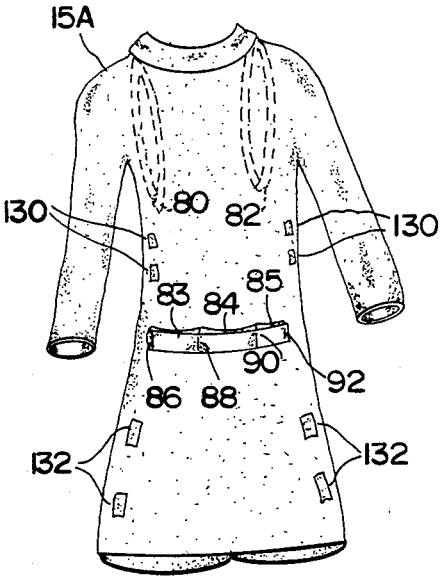
FIG. 13 is a perspective view of a coat having a midsection exterior strap forming a loop and an interior concealed top loop.
Figure 14:
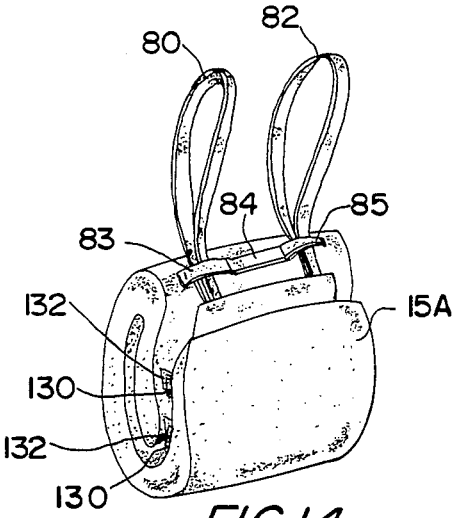
FIG. 14 is a perspective view of the invention of FIG. 13 folded and secured into the form of a carrying bag.

In FIGS. 13 and 14 the elongated element comprises two large looped pieces of material 80 and 82 secured inside a top of the article of clothing and the second element comprises a strip of material 84 attached to a midsection of the article of clothing with the ends and at least one interior point of the strip of material sewn to the article of clothing by stitches 86, 88, 90 and 92 so that at least two small loops 83 and 85 are formed between the strip of material and the article of clothing. The large looped pieces of material 80 and 82 are pulled out of the article of clothing through a top opening in the article of clothing and the large looped pieces of material are inserted through two of the small loops 83 and 85 when the article of clothing is folded to secure the bundle and to provide the two large loops 80 and 82 as carrying means as seen in FIG. 14.

Figure 15:
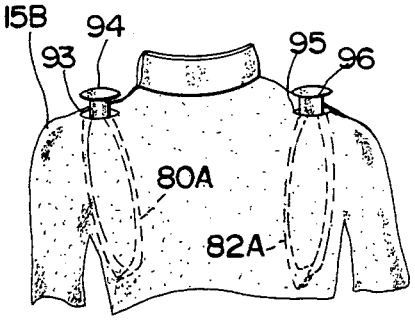
FIG. 15 is a partial perspective view of the back of a coat having an alternative pair of concealed top loops inserted through slits at the top of the coat and retained by buttons.

In FIG. 15 another embodiment of the invention provides an elongated element comprising two large looped pieces of material 80A and 82A slidably secured inside a top of the article of clothing by means of insertion of each of the two large looped pieces of material 80A and 82A through a small slit 93 and 95 formed in the article of clothing and the large looped pieces of material are each provided with a large button 94 and 96 attached to an end of the large looped piece of material to retain the large looped pieces of material in the slit. This embodiment is secured into a bundle in the same fashion as the embodiment of FIG. 14.

Figure 16:
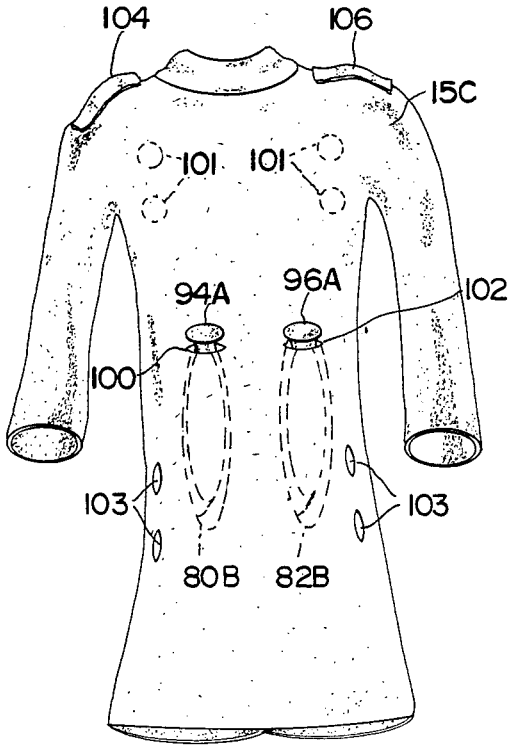
FIG. 16 is a perspective view of the back of a coat having midsection hidden midsection loops inserted through slits in the coat midsection of the coat with top exterior loops.
Figure 17:
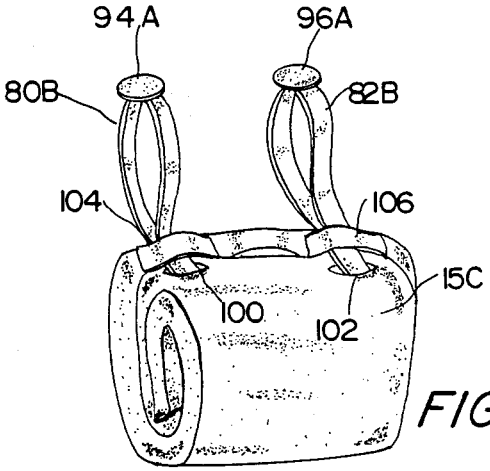
FIG. 17 is a perspective view of the embodiment of FIG. 16 folded and secured into a carrying bag.

In FIGS. 16 and 17 another embodiment of the invention provides an elongated element comprising two large looped pieces of material 80B and 82B slidably secured inside a midsection of the article of clothing by means of insertion of each of the two large looped pieces of material through a small slit 100 and 102 formed in the article of clothing and the large looped pieces of material are each provided with a large button 94A and 96A attached to an end of the large looped piece of material to retain the large looped piecs of material in the slit. Alternately the large looped pieces of material may be attached to the interior of the article of clothing and just pulled out through the slits, thereby covering the looped pieces of material from view when the article of clothing is being worn. The other element comprises two strips of material 104 and 106 attached to a top of the article of clothing with the ends of each strip of material sewn to the article of clothing so that the strip forms a small loop 104 and 106. The large looped pieces of material 80B and 82B are pulled out of the article of clothing through the slits 100 and 102 in the article of clothing and the large looped pieces of material are inserted through the two small loops 104 and 106 when the article of clothing is folded to secure the bundle and to provide the two large loops 80B and 82B extending from the secured bundle as carrying means as seen in FIG. 16.

In FIG. 18 another embodiment provides an elongated element comprises two large looped pieces of material 80C and 82C secured inside a bottom of the article of clothing 110. The other element comprises a strip of material attached to a midsection of the article of clothing, as in FIG. 13, with the ends and at least one interior point of the strip of material sewn to the article of clothing so that at least two small loops are formed between the strip of material and the article of clothing. The large looped pieces of material are pulled out of the article of clothing through a bottom opening in the article of clothing and the large looped pieces of material are inserted through two of the small loops when the article of clothing is folded to secure the bundle and to provide the two large loops as carrying means, similar to FIG. 14 with the bottom of the article of clothing in place of the top. When the article of clothing is worn, the two large loops 80C and 82C are tied to two interior loops 112 and 114 inside the article of clothing 110 to prevent the loops from hanging down below the article of clothing. A similar configuration of elongated loops at the bottom can be used with top loops at the top as in FIG. 17 with the bottom replacing the top of the article of clothing.

In FIGS. 19 and 20 another embodiment provides an elongated element comprising a long strip of material 120 permanently attached to an article of clothing on a portion of the clothing adjacent to where a fold is made in the article of clothing in forming a bundle wherein the ends of the long strip of material are sewn to the article of clothing so that a large loop 120 is formed between the long strip of material and the article of clothing, and the other element comprises a second strip of material 122 permanently attached to an article of clothing on another portion of the clothing adjacent to where another fold is made in the article of clothing. In forming a bundle wherein the ends of the second strip of material are sewn to the article of clothing so that a second loop 122 is formed between the second strip of material and the article of clothing, and when the article of clothing is folded to form a bundle the two loops are adjacent to one another and the large loop is inserted through the second loop to secure the bunble and the large loop extends from the secured bundle as a carrying means as seen in FIG. 19. The large loop may be inside one end of the article of clothing adjacent to an opening in the article of clothing and the second loop is positioned in a midsection of the article of clothing. Alternately the large loop may be inside one end of the article of clothing adjacent to an opening in the article of clothing and the second loop positioned at an opposite end of the article of clothing.

In FIG. 13 mating hook and loop fasteners 130 and 132 are positioned along opposing side edges of the secured bundle to secure the sides of the bundle to prevent articles stored inside the bundle from falling out. Alternately, in FIG. 16, buttons 101 (shown with dashed lines) and mating button-holes 103 are positioned along opposite side edges of the coat to secure the sides of the bundle together.

In FIG. 21 the elements of a kit for transforming an existing article of clothing into an article of clothing which converts to a carrying bag comprise two long strips of material 130 and 132 to be used as large loops, two shorter strips of material 134 and 136 to be used as smaller loops, two mating pair of Velcro (hook and loop) fasteners 138 and 140 and two buttons 142 and 144. The elements are easily stitched to any article of clothing in any desired configuration and style.

In FIGS. 22 and 23 an alternate embodiment of the article of clothing 15F is provided with external or internal bottom straps or loops of material 80D and 82D which are secured to the article of clothing when being worn by buttoning (or fastening by other means) the straps or loops of material to the article of clothing in either a vertical configuration as in FIG. 22 or a criss-crossed configuration as in FIG. 23. The straps or loops of material are inserted through loops as in the previous examples to secure the carrying bag and act as handles for carrying the carrying bag.

In FIGS. 24 and 25 another alternate embodiment of the invention 15G comprises mating zipper elements 160 and 162 and adjacent loops 120A and 122A. The upper zipper may be concealed beneath overlapping material 164 in the article of clothing shown lifted in FIG. 24 to reveal the zipper element 160 normally beneath it in wearing the article of clothing. After the article of clothing is folded into a carrying bag the zipper elements 160 and 162 are zipped together and the large loop 120A is inserted through the small loop 122A to aid in securing the carrying bag and to act as a handle for the carrying bag. Mating hook and loop fasteners or other fastening means 130 and 132 are attached to the sides of the article of clothing to secure the sides of the bundle together and further help to retain any articles such as a book 170 (shown with dashed lines) which may be carried inside.

Many combinations of the previously described elements are possible and the kit version of applying the invention elements to an existing article of clothing provides the opportunity for the user to choose a desired combination.

It is understood that the preceding description is given merely by way of illustration and not in limitation of the invention and that various modifications may be made thereto without departing from the spirit of the invention as claimed.

I claim:

1. An article of clothing which converts from an article of apparel to a self-contained carrying bag having holding means, wherein the article of clothing comprises:

an article of clothing wherein the article of clothing folds into a secure bundle by overlapping portions of the article of clothing so that the secure bundle has an interior space for carrying articles;

secured to the article of clothing a securing/carrying means for reversibly securing the article of clothing in an enclosed bundle configuration and for serving as a carrying element to transport the enclosed bundle and any articles placed therein;

wherein the securing/carrying means comprises at least one elongated element permanently secured to a first position on the article of clothing and a second element permanently secured to a second position on the article of clothing so that when the article of clothing is folded the elongated element contacts the second element and is reversibly secured to the second element so that the article of clothing is formed into a secured bundle and the elongated element forms at least one loop for carrying the secured bundle;

attached to the sides of the article of clothing mating closure means for securing the sides of the article of clothing together when folded into a carrying bag;

wherein the elongated element is concealed in part by other portions of the article of clothing when the article of clothing is being worn;

wherein the elongated element comprises at least one large loop secured to the article of clothing and the second element comprises at least one small loop attached to the article of clothing at a distance from the large loop, wherein the large loop is inserted through the small loop to secure the bundle and the large loop is used for carrying the secured bundle;

and wherein the elongated element comprises two large looped pieces of material secured inside a top of the article of clothing and the second element comprises a strip of material attached to a midsection of the article of clothing with the ends and at least one interior point of the strip of material sewn to the article of clothing so that at least two small loops are formed between the strip of matererial and the article of clothing, wherein the large looped pieces of material are pulled out of the article of clothing through a top opening in the article of clothing and the large looped pieces of material are inserted through two of the small loops when the article of clothing is folded to secure the bundle and to provide the two large loops as carrying means.

2. The invention of claim 1 wherein the closure means comprises mating hook and loop fasteners positioned along opposing side edges of the secured bundle to secure the sides of the secured bundle to prevent articles stored inside the bundle from falling out when in use as a carrying bag.

3. The invention of claim 1 wherein the closure means comprises mating buttons and button holes positioned along opposing side edges of the secured bundle to secure the sides of the secured bundle to prevent articles stored inside the bundle from falling out when in use as a carrying bag.

4. The invention of claim 1 wherein the closure means comprises mating strips of material to be tied together positioned along opposing side edges of the secured bundle to secure the sides of the secured bundle to prevent articles stored inside the bundle from falling out when in use as a carrying bag.

5. An article of clothing which converts from an article of apparel to a self-contained carrying bag having holding means, wherein the article of clothing comprises:

an article of clothing wherein the article of clothing folds into a secure bundle by overlapping portions of the article of clothing so that the secure bundle has an interior space for carrying articles;

secured to the article of clothing a securing/carrying means for reversibly securing the article of clothing in an enclosed bundle configuration and for serving as a carrying element to transport the enclosed bundle and any articles placed therein;

wherein the securing/carrying means comprises at least one elongated element permanently secured to a first position on the article of clothing and a second element permanently secured to a second position on the article of clothing so that when the article of clothing is folded the elongated element contacts the second element and is reversibly secured to the second element so that the article of clothing is formed into a secured bundle and the elongated element forms at least one loop for carrying the secured bundle;

attached to the sides of the article of clothing mating closure means for securing the sides of the article of clothing together when folded into a carrying bag; wherein the elongated element is concealed in part by other portions of the article of clothing when the article of clothing is being worn;

wherein the elongated element comprises at least one large loop secured to the article of clothing and the second element comprises at least one small loop attached to the article of clothing at a distance from the large loop, wherein the large loop is inserted through the small loop to secure the bundle and the large loop is used for carrying the secured bundle;

wherein the elongated element comprises two large looped pieces of material slidably secured inside a top of the article of clothing by means of insertion of each of the two large looped pieces of material through a small slit formed in the article of clothing and the large looped pieces of material are each provided with a large button attached to an end of the large looped piece of material to retain the large looped piecs of material in the slit, and the other element comprises a strip of material attached to a midsection of the article of clothing with the ends and at least one interior point of the strip of material sewn to the article of clothing so that at least two small loops are formed between the strip of material and the article of clothing, wherein the large looped pieces of material are pulled out of the article of clothing through the slits in the article of clothing and the large looped pieces of material are inserted through two of the small loops when the article of clothing is folded to secure the bundle and to provide the two large loops extending from the secured bundle as carrying means.

6. The invention of claim 5 wherein the closure means comprises mating hook and loop fasteners positioned along opposing side edges of the secured bundle to secure the sides of the secured bundle to prevent articles stored inside the bundle from falling out when in use as a carrying bag.

7. The invention of claim 5 wherein the closure means comprises mating buttons and button holes positioned along opposing side edges of the secured bundle to secure the sides of the secured bundle to prevent articles stored inside the bundle from falling out when in use as a carrying bag.

8. The invention of claim 5 wherein the closure means comprises mating strips of material to be tied together positioned along opposing side edges of the secured bundle to secure the sides of the secured bundle to prevent articles stored inside the bundle from falling out when in use as a carrying bag.

9. An article of clothing which converts from an article of apparel to a self-contained carrying bag having holding means, wherein the article of clothing comprises:

an article of clothing wherein the article of clothing folds into a secure bundle by overlapping portions of the article of clothing so that the secure bundle has an interior space for carrying articles;

secured to the article of clothing a securing/carrying means for reversibly securing the article of clothing in an enclosed bundle configuration and for serving as a carrying element to transport the enclosed bundle and any articles placed therein;

wherein the securing/carrying means comprises at least one elongated element permanently secured to a first position on the article of clothing and a second element permanently secured to a second position on the article of clothing so that when the article of clothing is folded the elongated element contacts the second element and is reversibly secured to the second element so that the article of clothing is formed into a secured bundle and the elongated element forms at least one loop for carrying the secured bundle;

attached to the sides of the article of clothing mating closure means for securing the sides of the article of clothing together when folded into a carrying bag; wherein the elongated element is concealed in part by other portions of the article of clothing when the article of clothing is being worn;

wherein the elongated element comprises at least one large loop secured to the article of clothing and the second element comprises at least one small loop attached to the article of clothing at a distance from the large loop, wherein the large loop is inserted through the small loop to secure the bundle and the large loop is used for carrying the secured bundle;

wherein the elongated element comprises two large looped pieces of material are slidably secured inside a midsection of the article of clothing by means of insertion of each of the two large looped pieces of material through a small slit formed in the article of clothing and the large looped pieces of material are each provided with a large button attached to an end of the large looped piece of material to retain the large looped pieces of material in the slit, and the other element comprises two strips of material attached to a top of the article of clothing with the ends of each strip of material sewn to the article of clothing so that a small loop is formed between each strip of material and the article of clothing, wherein the large looped pieces of material are pulled out of the article of clothing through the slits in the article of clothing and the large looped pieces of material are inserted through the two small loops when the article of clothing is folded to secure the bundle and to provide the two large loops extending from the secured bundle as carrying means.

10. The invention of claim 9 wherein the closure means comprises mating hook and loop fasteners positioned along opposing side edges of the secured bundle to secure the sides of the secured bundle to prevent articles stored inside the bundle from falling out when in use as a carrying bag.

11. The invention of claim 9 wherein the closure means comprises mating buttons and button holes positioned along opposing side edges of the secured bundle to secure the sides of the secured bundle to prevent articles stored inside the bundle from falling out when in use as a carrying bag.

12. The invention of claim 9 wherein the closure means comprises mating strips of material to be tied together positioned along opposing side edges of the secured bundle to secure the sides of the secured bundle to prevent articles stored inside the bundle from falling out when in use as a carrying bag.

* * * * *